US006926281B1

(12) United States Patent
Woock

(10) Patent No.: US 6,926,281 B1
(45) Date of Patent: Aug. 9, 2005

(54) COMPRESSED FOAM TARGET

(75) Inventor: Laverne Woock, Reinbeck, IA (US)

(73) Assignee: Garrett Corporation, Reinbeck, IA (US)

( * ) Notice: Subject to any disclaimer, the term of this patent is extended or adjusted under 35 U.S.C. 154(b) by 54 days.

(21) Appl. No.: 10/707,848

(22) Filed: Jan. 16, 2004

(51) Int. Cl.[7] ..... F41J 3/00
(52) U.S. Cl. ..... 273/403; 273/408
(58) Field of Search ..... 243/403, 404, 243/407, 408

(56) References Cited

U.S. PATENT DOCUMENTS

| | | | | |
|---|---|---|---|---|
| 3,048,401 | A | 8/1962 | Dishon | |
| 3,088,738 | A | 5/1963 | Meyer | |
| 3,396,971 | A | 8/1968 | Estep | |
| 3,479,390 | A | 11/1969 | Roloff et al. | |
| 3,512,778 | A | 5/1970 | Allen | |
| 4,066,261 | A * | 1/1978 | Stewart | 273/403 |
| 4,076,246 | A | 2/1978 | Meyer | |
| 4,126,501 | A | 11/1978 | Croll | |
| 4,235,444 | A | 11/1980 | Meyer | |
| 4,239,573 | A * | 12/1980 | Wu | 156/245 |
| 4,244,585 | A | 1/1981 | Croll | |
| 4,294,452 | A * | 10/1981 | Schlotter et al. | 273/403 |
| 4,813,684 | A | 3/1989 | Bruno | |
| 4,850,596 | A | 7/1989 | Olund | |
| 4,940,244 | A * | 7/1990 | Batts, III | 273/403 |
| 5,002,285 | A | 3/1991 | Morrell | |
| 5,029,874 | A | 7/1991 | Lamboy | |
| 5,087,053 | A | 2/1992 | Head | |
| 5,290,042 | A | 3/1994 | Worley et al. | |
| 5,465,977 | A | 11/1995 | Mann | |
| 5,503,403 | A * | 4/1996 | Morrell | 273/403 |
| 5,865,440 | A | 2/1999 | Pulkrabek | |
| 5,979,899 | A | 11/1999 | Wilson | |
| 6,068,261 | A | 5/2000 | Nettle | |
| 2003/0222403 | A1 * | 12/2003 | Ingold | 273/408 |
| 2004/0108659 | A1 * | 6/2004 | Pulkrabek | 273/404 |

FOREIGN PATENT DOCUMENTS

| | | |
|---|---|---|
| WO | WO 90/15964 | 12/1990 |

* cited by examiner

*Primary Examiner*—Mark S. Graham
(74) *Attorney, Agent, or Firm*—Glenn Johnson; Ryan N. Carter

(57) ABSTRACT

A compressed foam target, primarily for archery use, made of layered foam material. Cross-linked polyethylene foam sheets are used, each having a thickness of one-eighth (⅛") inch with a density of four (4.0) pounds per square inch. The foam sheets are assembled either horizontally or vertically to create the arrow receiving area and are compressed to a size 60% of their original size. After compression, the foam sheets are slidably placed into a reinforced flexible sleeve made of polypropylene which circumferentially restrains the foam sheets, but allows expansion of the foam sheets from the 40% compressed state to the 28% compressed state. The circumferentially restrained foam sheets create the arrow receiving area of the target which can then be placed within a frame to make the full scale target or can be molded within a polyurethane insert for use as a replaceable insert in a flat faced target or a three-dimensional target.

2 Claims, 6 Drawing Sheets

COMPRESSED FOAM TARGET

BACKGROUND OF INVENTION

Bow hunting of wild game and the sport of archery have increased in popularity within the United States over the years. This increase in popularity has developed a greater interest in the use of archery targets. This also has created a mounting need for increased functionality and durability of those archery targets.

There are a number of archery targets described in prior art references or which are otherwise available in the market which employ any variety of interior materials for purposes of receiving the arrow. For example, in the Nettle's patent, U.S. Pat. No. 6,068,261, the archery target employs a solid clay core for receiving arrows, which core is surrounded by high density foam. The Worley patent, U.S. Pat. No. 5,290,042, employs wheat straw or other organic material. The Mann patent, U.S. Pat. No. 5,465,977, describes an archery target made out of stacks of carpet strips.

In addition to the other materials described, a single foam interior or foam layers have been used to form the arrow receiving portion of the target. As such, the use of layered plastic or foam is not unique. For example, in Meyer, U.S. Pat. No. 4,076,246, the target material consists of layered elastomeric plastic sheets encapsulating a polypropylene foam material. These plastic sheets are sufficiently rigid to stand, and are grouped together in replaceable segments of target material. The replaceable segments are wrapped in a plastic sheet material, and weather-resistant plastic sheet material covers the exterior of the target. The interior foam material designed to receive the arrow is sufficiently stiff so as to not require any compressive forces in order to have it retain its shape or position within the interior of the target.

In Pulkrabek, U.S. Pat. No. 5,865,440, the material for receiving the arrow is arranged in horizontal layers. These layers are polyethylene foam. In order to retain the foam layers within the target structure, the foam is compressed in a baling apparatus. The bottom of the target on which the foam layers rests is comprised of a base board with the top comprising a covering board. These boards, and the foam layers contained between them, are circumferentially wrapped in steel or nylon bands which are drawn tight to maintain the compressive forces necessary to retain the foam layers.

Many of the targets described in the prior art are full-scale in size, and square or rectangular in shape. The entire area of the face is flat and designed to receive arrows. Customarily, these flat-faced full scale targets provide little or no visual imagery of the game that may be pursued by bow hunters. The present invention includes such flat-faced full scale targets that are of a square or rectangular shape. It also includes the manufacture of replaceable insert sections for use in the conventional flat-faced design of archery target. Bow hunters, however, generally have a preference for three-dimensional archery targets representing game animals. An example of such a three-dimensional target is a white tailed deer. Such three-dimensional targets have a "vital" section that represents the location where the bow hunter should place the arrow when hunting the live game animals so as to achieve the most effective kill. With such three-dimensional targets, the vital section is often replaceable thereby extending the useful life of the three-dimensional figure as a target.

SUMMARY OF INVENTION

The current invention encompasses both full-scale targets as well as the replaceable insert sections used in both flat-faced targets and three-dimensional targets. It employs the use of layered foam material to create the arrow receiving area of the target. In the current invention the arrow receiving area may utilize either horizontal foam layers or vertical foam layers. In order to retain appropriate compressive forces upon the foam layers, an flexible sleeve is used to circumferentially encapsulate the foam layers. The use of the flexible sleeve accomplishes two significant features. First, it is much lighter than a target using boards and bands or other compressive retaining means, thus easier to move in the field or to mount as an insert in a flat-faced target or the vital area within a three-dimensional target. Second, the target is manufactured by way of less complicated and more economical means.

DETAILED DESCRIPTION

Figure 1:
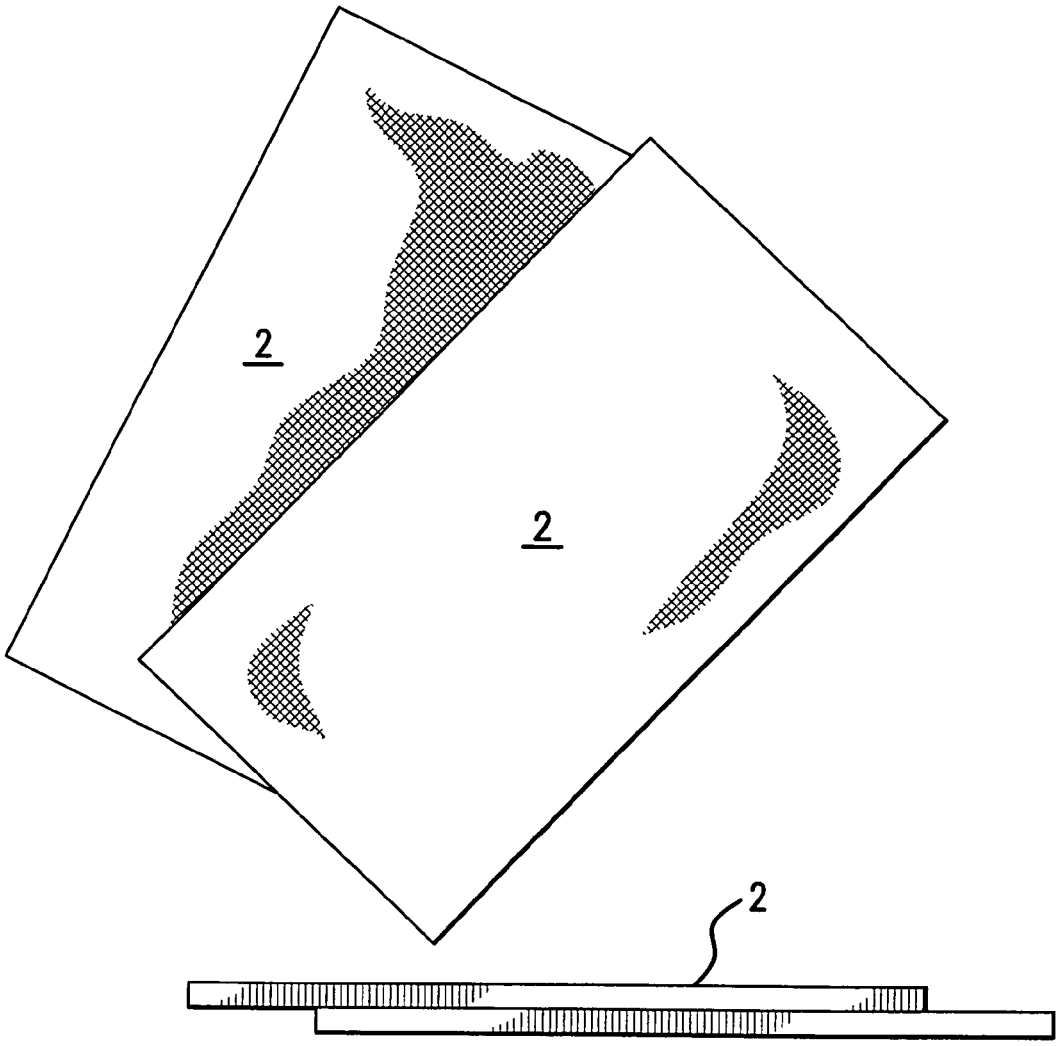
FIG. 1 is a drawing of the single foam sheets used in multiple stacked arrangement to form the arrow receiving area of the target.

An insert assembly machine is used for making the arrow receiving area 1 of the target. In order to make the arrow receiving area 1 of the target, open or closed cell foam sheets 2 are used. FIG. 1 shows a single foam sheet 2. These foam sheets 2 have a thickness between one-sixteenth of an inch (1/16") to one-quarter of an inch (1/4") with a density range of three (3.0) pounds per square inch to seven (7.0) pounds per square inch. Optimally, crosslinked polyethylene foam material having a thickness of one-eighth inch (1/8") with a density of four (4.0) pounds per square inch is utilized.

Figure 2:
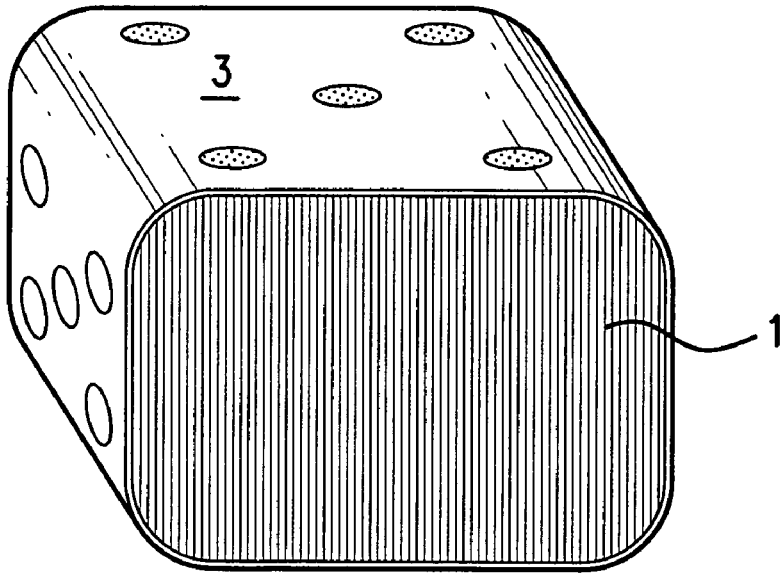
FIG. 2 is an end view of the arrow receiving area comprised of compressed foam layers.
Figure 3:
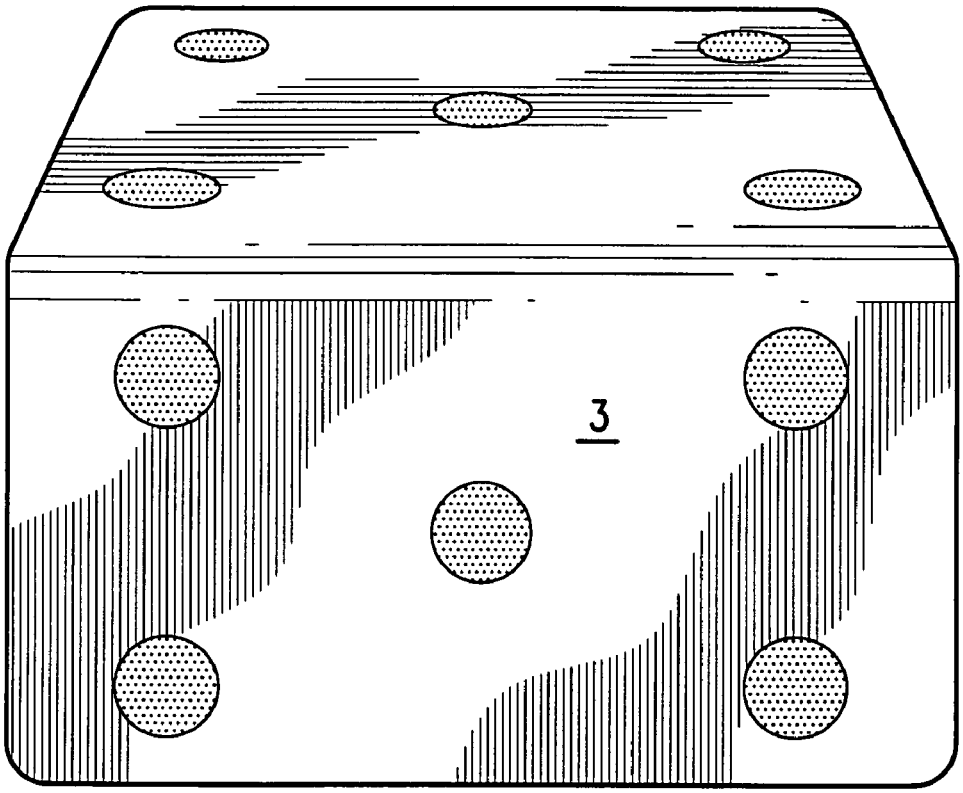
FIG. 3 is a side view of the arrow receiving area showing the flexible sleeve used to circumferentially encapsulate the compressed foam layers.

The bulk foam material is cut to create the foam sheet 2 of a predetermined length and width as called for by the arrow receiving area 1 of the target under construction. The arrow receiving area 1 is shown in FIG. 2 and FIG. 3. In this operation, each foam sheet 2 is cut to a length in excess of the desired length of the final arrow receiving area 1 of the target, preferably about one inch (1"). After cutting to the desired size, each foam sheet 2 is stacked one on another to create the arrow receiving area 1. The number of foam sheets to create the arrow receiving area 1 is dependent upon the desired size of the arrow receiving area 1 for the target under construction.

An insert assembly machine is utilized to assemble the foam sheets 2 into the arrow receiving area 1. After stacking, the foam sheets 2 are placed in the loading area of the insert assembly machine. The loading area is positioned within the frame of the insert assembly machine. The loading area is comprised of an open chamber having a smooth floor, a smooth back wall, and a hinged front door having a smooth inner surface which comprises the front wall. The loading area operates to hold the stacked foam sheets 2 in place. Positioned above the loading area is a flat compression plate which, in the preferred operation, is pneumatically operated. When activated, the compression plate is actuated downwardly, functioning to compress the stacked foam sheets 2 to form the compressed the arrow receiving area 1. It is preferred that the stacked foam sheets 2 be compressed by up to 40% of its uncompressed height in the formation of the arrow receiving area 1. For example, if the uncompressed height of the stacked foam sheets 2 was eleven and one-quarter inches (11¼), the stacked foam sheets 2 would be compressed to about six and three-fourths inches (6¾").

The insert assembly machine is fitted with a chute on one side of the loading area and with a cam arm with a flat push plate on the opposing side. So as to maintain the compression of the stacked foam sheets 2 as the stack is pushed out of the loading area, the interior diameter of the chute is dimensioned to conform with the outer diameter dimensions of the stacked foam sheets 2 as compressed. The chute is also customarily of a length that is shorter than the length of the stacked foam sheets 2, preferably by one (1") or two (2") inches. Once compressed, the stacked foam sheets 2 are pushed out of the assembly area and through the chute by the cam arm. A pneumatic cam arm is preferred for this operation. A flexible sleeve 3 is placed over the exterior of the chute, preferably extending the full length of the chute and extending slightly beyond the exit opening of the chute. The length of the flexible sleeve 3 preferably matches the length of the stacked foam sheets 2. As positioned on the chute, the flexible sleeve 3 extends beyond the end of the chute by one (1") to two (2") inches, said distance being necessary to frictionally capture the compressed stacked foam sheets 2 as they emerge from the open end of the chute. The flexible sleeve 3 as applied to retain the stacked foam sheets 2 is seen in FIG. 3. As demonstrated in FIG. 2, the flexible sleeve 3 circumferentially covers the stacked foam sheets 2 to create the arrow receiving area 1. Preferably the flexible sleeve 3 is made of polypropylene, is constructed with a weave or other reinforcing structure known to the industry, and is fitted around the chute without being secured awaiting the discharge of the compressed stacked foam sheets 2. Other materials may be used for the flexible sleeve 3. These materials include polyethylene, nylon, fiberglass cloth, and Kevlar. As the cam arm pushes the compressed stacked foam sheets 2 out of the loading area and through the chute, the compressed stacked foam sheets 2 are inserted into the flexible sleeve 3. The length of travel of the cam arm is, preferably, of a distance such that the flat end plat positioned against the compressed stacked foam sheets 2 travels to the end of the chute when the cam arm is fully extended, thus inserting the compressed stacked foam sheets 2 fully within the flexible sleeve 3 while fully discharging the assembled arrow receiving area 1 from the end of the chute. This action results in the compressed stacked foam sheets 2 expanding upon exit of the end opening of the chute. As it expands, the compressed stacked foam sheets 2 frictionally capture the inner diameter of the end of the flexible sleeve 3 with the flexible sleeve 3 being pulled off of the chute and enveloping the compressed stacked foam sheets 2 as the compressed stacked foam sheets 2 are pushed through and out of the chute. The end result of this operation is that the flexible sleeve 3 circumferentially captures the compressed stacked foam sheets 2 to create the completed arrow receiving area 1.

As the compressed stacked foam sheets 2 enters the flexible sleeve 3, due to its elasticity the compressed stacked foam sheets 2 attempt to return to their original, uncompressed state. The flexible sleeve 3, however, restrains the compressed stacked foam sheets 2 preventing a complete recovery to original, uncompressed state for each foam sheet 2. It is preferred that the flexible sleeve 3 stretch so as to allow a recovery of the compressed stacked foam sheets 2 from a state of about 40% compression to a state of about 28% compression. Referring to the above example, this would represent a recovery of the compressed stacked foam sheets 2 from about six and three-fourths inches (6¾") to about eight inches (8") in height. The recovery of the compressed stacked foam sheets 2 within the flexible sleeve 3 functions to distribute pressure around the exterior of the stacked, compressed foam sheets 2 so that the forces acting upon the center of the stacked foam sheets 2 are sufficient to retain the center section and the outer edges of the arrow receiving area 1 in place as the target is used by archers.

For use as a conventional flat-faced full faced target, the arrow receiving area 1 may be placed within a frame structure having a handle 5. The frame structure is fitted to the outer dimensions of the arrow receiving area 1 so as to securely retain the arrow receiving area 1 as the target is carried or used.

Figure 4:
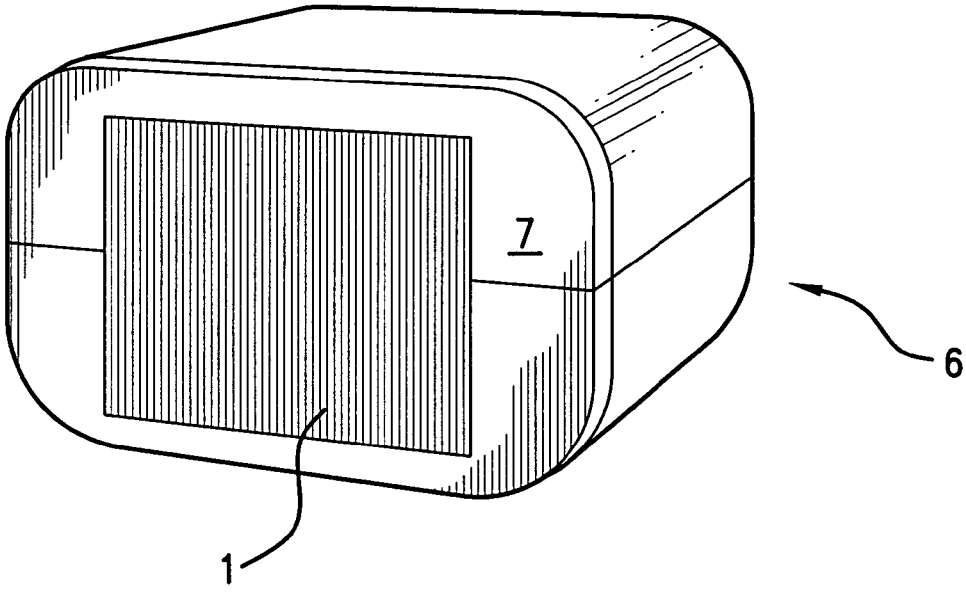
FIG. 4 is an end view of the vital area of a three-dimensional target comprised of circumferentially encapsulated compressed foam layers molded within the textured foam shell that can be easily placed in position within the three-dimensional target.
Figure 5:
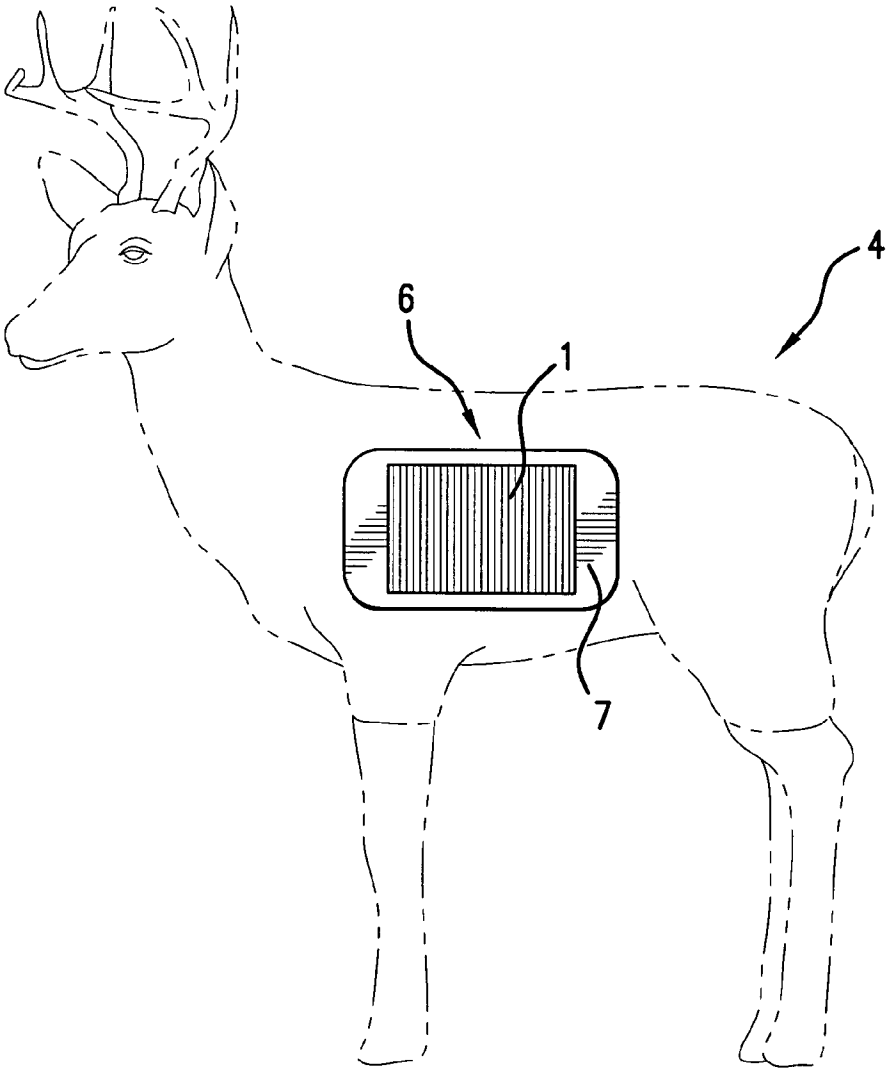
FIG. 5 shows a three-dimensional target having a vital area comprised of the compressed foam layers circumferentially encapsulated within the sleeve.
Figure 6:
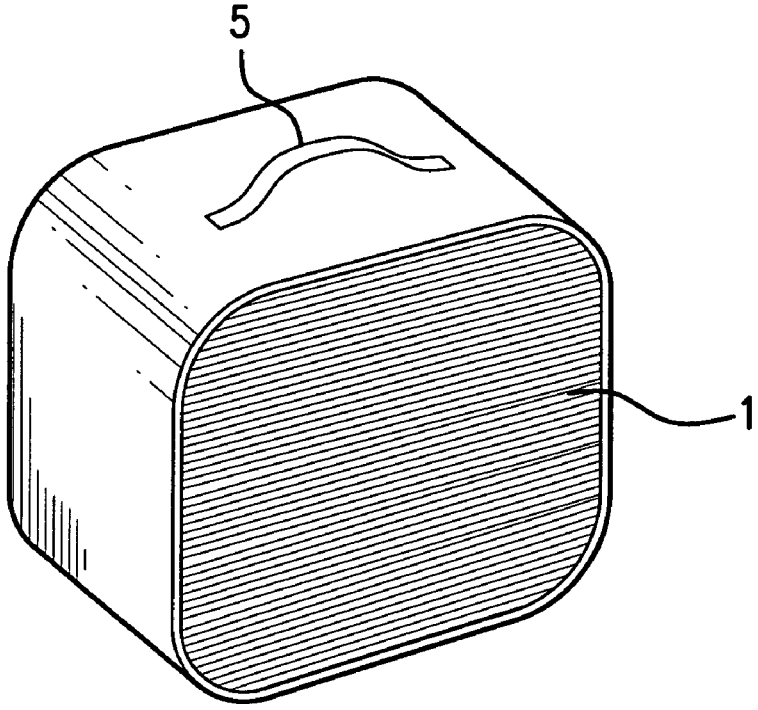
FIG. 6 shows a standard full-size target utilizing the features of this invention.

While this process can create a conventional flat-faced full scale target as shown by FIG. 6, this process is particularly useful for making the replaceable insert for use in flat-faced targets and vital area inserts 6 for use in three-dimensional targets 4. FIG. 4 demonstrates a vital area insert 6 for use in a three-dimensional target 4. FIG. 5 shows an example of a three-dimensional target 4 into which is positioned the vital area insert 6. For use as an insert in flat-faced targets or as the vital area insert 6 in three-dimensional targets 4, the arrow receiving area 1, comprised of the compressed stacked foam sheets 2 circumferentially held in place by the flexible sleeve 3 is next placed and centered within a mold. Customarily, the arrow receiving area 1 would be maintained in the centered position within the interior of the mold by a stand assembly or shelves constructed within the mold. Preferably, the arrow receiving area 1 extends by up to one-half inch (½") beyond each exterior surface of the vital area insert 6 being made by this process. After positioning the arrow receiving area 1 within the mold, the foam material 7 is injected into the open cavity of the mold thereby surrounding the sides of the arrow receiving area 1. It is preferred that the injected foam material 7 be polyurethane comprised of a two-part elastomer having a density range of four (4.0) pounds to nine (9.0) pounds with a density of five (5.0) pounds considered as optimal. Customary injection foam molding procedures and practices are utilized in this step of the operation. The end result of this process of molding is the creation of an insert for a flat-faced target, or the creation of the vital area insert 6 of the three-dimensional target 4.

Upon removal of the insert from the mold, the flash is trimmed by the conventional means known to the injection molding industry. Further, it is preferred that each end of the arrow receiving area 1 is cut with a saw to create a smooth surface flush with the exterior sides of the insert or the vital area insert 6. Thereafter, the insert or the vital area insert 6 is painted as necessary to conform to the exterior finish of the target into which it is to be fitted. After the painting operation, if required, the insert assembled within a new flat-faced target or the vital area insert 6 is assembled within the new three-dimensional target 4. Alternatively, the insert or the vital area insert 6 are packaged for distribution as a replacement parts for targets in use in the field.

While the preferred embodiment of the invention is set forth herein, other embodiments may be suggested to those skilled in the art. As such, the invention described in the following claims. The scope and spirit of the invention, however, contemplates various alternate designs and modifications.

What is claimed is:

1. A method of making an archery target having a flexible sleeve wrapped around a plurality of foam sheets having a first arrow receiving end and a second arrow receiving end, said method comprising:

placing a plurality of foam sheets adjacent to each other;

compressing the plurality of foam sheets;

applying the flexible sleeve circumferentially around the compressed foam sheets so that the foam sheets remain in their compressed state;

placing the compressed foam sheets circumferentially wrapped in the flexible sleeve into a mold wherein the mold is larger than the compressed foam sheets so that an open cavity is created circumferentially around the flexible sleeve; and introducing a foam material into the open cavity of the mold circumferentially around the outside of the flexible sleeve so that the first and second arrow receiving ends of the foam sheets are not covered by the foam material.

2. The method of claim 1 further comprising cutting at least one of the arrow receiving ends to create a smooth surface on the arrow receiving end.

* * * * *